US010068449B2

(12) United States Patent
Ellers

(10) Patent No.: US 10,068,449 B2
(45) Date of Patent: Sep. 4, 2018

(54) RFID PROXIMITY TACK FOR RFID DETACHER

(71) Applicant: Edward P. Ellers, Boca Raton, FL (US)

(72) Inventor: Edward P. Ellers, Boca Raton, FL (US)

(73) Assignee: Tyco Fire & Security GmbH, Neuhausen AM Rheinfall (CH)

( * ) Notice: Subject to any disclaimer, the term of this patent is extended or adjusted under 35 U.S.C. 154(b) by 0 days.

(21) Appl. No.: 14/974,491

(22) Filed: Dec. 18, 2015

(65) Prior Publication Data

US 2017/0178479 A1 Jun. 22, 2017

(51) Int. Cl.
*G08B 13/24* (2006.01)
*E05B 73/00* (2006.01)

(52) U.S. Cl.
CPC ..... *G08B 13/2434* (2013.01); *G08B 13/242* (2013.01); *G08B 13/246* (2013.01); *E05B 73/0047* (2013.01)

(58) Field of Classification Search
CPC ..... G08B 13/2434; G08B 13/246
See application file for complete search history.

(56) References Cited

U.S. PATENT DOCUMENTS 4,553,136 A 11/1985 Anderson, III et al.
5,426,419 A 6/1995 Nguyen et al.
5,528,914 A 6/1996 Nguyen et al.
5,535,606 A 7/1996 Nguyen et al.
5,942,978 A * 8/1999 Shafer ..... E05B 73/0017 340/10.5
5,955,951 A 9/1999 Wischerop et al.
6,121,878 A 9/2000 Brady et al.
7,286,054 B2 * 10/2007 Skjellerup ..... E05B 73/0017 340/568.1

(Continued)

FOREIGN PATENT DOCUMENTS

AU 2012202003 5/2012
WO 94 14143 A1 6/1994

(Continued)

OTHER PUBLICATIONS

PCT International Search Report and Written Opinion of the International Searching Authority (EPO) for International Application No. PCT/US2016/067568 (dated Mar. 3, 2017).

*Primary Examiner* — Brian Zimmerman
*Assistant Examiner* — Sara Samson
(74) *Attorney, Agent, or Firm* — Fox Rothschild LLP; Robert J. Sacco; Carol E. Thorstad-Forsyth

(57) ABSTRACT

Systems (100, 1300) and methods (1700, 1800) for detaching a tag (1304) from an article. The methods comprise: detecting when the tag is in proximity to a detaching unit (1302); verifying that the article has been accepted for a purchase transaction or has been successfully purchased using information received from the tag; mechanically coupling a tag body to the detaching unit when it has been verified that the article has been accepted for a purchase transaction or has been successfully purchased; detecting when a pin (1306) of the tag is no longer in proximity of the detaching unit; and mechanically decoupling the tag body from the detaching unit when the pin is no longer in proximity to the detaching unit.

18 Claims, 13 Drawing Sheets

(56) References Cited

U.S. PATENT DOCUMENTS

| | | | | |
|---|---|---|---|---|
| 7,391,327 | B2 | 6/2008 | Ho | |
| 7,804,411 | B2 | 9/2010 | Copeland | |
| 7,973,661 | B2 | 7/2011 | Copeland | |
| 2005/0104733 | A1* | 5/2005 | Campero | G08B 13/246 340/572.9 |
| 2006/0125643 | A1* | 6/2006 | Skjellerup | E05B 73/0017 340/572.9 |
| 2006/0208908 | A1 | 9/2006 | Skjellerup et al. | |
| 2006/0273902 | A1 | 12/2006 | Shafer et al. | |
| 2007/0188333 | A1 | 8/2007 | Clancy et al. | |
| 2009/0224918 | A1 | 9/2009 | Copeland | |
| 2009/0309732 | A1 | 12/2009 | Truscott et al. | |
| 2010/0141452 | A1 | 6/2010 | Lian et al. | |
| 2014/0232531 | A1 | 8/2014 | Stewart et al. | |
| 2014/0253333 | A1* | 9/2014 | Patterson | E05B 73/0064 340/572.4 |
| 2015/0187150 | A1* | 7/2015 | Favier | E05B 73/0047 340/5.6 |

FOREIGN PATENT DOCUMENTS

| | | | |
|---|---|---|---|
| WO | 2005 083655 | A2 | 9/2005 |
| WO | 2009020563 | A1 | 2/2009 |

* cited by examiner

RFID PROXIMITY TACK FOR RFID DETACHER

FIELD OF THE INVENTION

This document relates generally to security tag detachment systems. More particularly, this document relates to systems and methods for determining if a tack has been removed from a security tag while in a detacher nest.

BACKGROUND OF THE INVENTION

Electronic Article Surveillance ("EAS") systems are often used by retail stores in order to minimize loss due to theft. One common way to minimize retail theft is to attach a security tag to an article such that an unauthorized removal of the article can be detected. In some scenarios, a visual or audible alarm is generated based on such detection. For example, a security tag with an EAS element (e.g., an acousto-magnetic element) can be attached to an article offered for sale by a retail store. An EAS interrogation signal is transmitted at the entrance and/or exit of the retail store. The EAS interrogation signal causes the EAS element of the security tag to produce a detectable response if an attempt is made to remove the article without first detaching the security tag therefrom. The security tag must be detached from the article upon purchase thereof in order to prevent the visual or audible alarm from being generated.

One type of EAS security tag can include a tag body which engages a tack. The tack usually includes a tack head and a sharpened pin extending from the tack head. In use, the pin is inserted through the article to be protected. The shank or lower part of the pin is then locked within a cooperating aperture formed through the housing of the tag body. In some scenarios, the tag body may contain a Radio Frequency Identification ("RFID") element or label. The RFID element can be interrogated by an RFID reader to obtain RFID data therefrom.

The EAS security tag may be removed or detached from the article using a detaching unit. Examples of such detaching units are disclosed in U.S. Patent Publication No. 2014/0208559 ("the '559 patent application) and U.S. Pat. No. 7,391,327 ("the '327 patent"). The detaching units disclosed in the listed patents are designed to operate upon a two-part hard EAS security tag. Such an EAS security tag comprises a pin and a molded plastic enclosure housing EAS marker elements. During operation, the pin is inserted through an article to be protected (e.g., a piece of clothing) and into an aperture formed through at least one sidewall of the molded plastic enclosure. The pin is securely coupled to the molded plastic enclosure via a clamp disposed therein. The pin is released by a detaching unit via application of a magnetic field by a magnet or mechanical probe inserted through an aperture in the hard tag. The magnet or mechanical probe is normally in a non-detach position within the detaching unit. When the RFID enabled hard tag is inserted into the RFID detacher nest, a first magnetic field or mechanical clamp is applied to hold the tag in place while the POS transaction is verified. Once the transaction and payment have been verified, the second magnet or the mechanical probe is caused to travel from the non-detach position to a detach position so as to release the tag's locking mechanism (e.g., a clamp). The pin can now be removed from the tag. Once the pin is removed and the article is released, the security tag will be ejected or unclamped from the detacher nest.

While EAS security tags help reduce retail theft, improper use of the detaching unit is an ever growing problem that is inhibiting the effectiveness of the security tags. For example, an unscrupulous store employee may conspire to allow customers to steal merchandise by a practice known as "sweethearting". "Sweethearting" involves collusion between the store employee and a customer. Typically, a cashier scans an inexpensive item for the customer to ring a sale and apparently complete the transaction. But then the cashier uses a detaching unit to remove the EAS security tag from a much more expensive item which was not scanned. The customer is then free to leave the premises with the expensive item without having paid therefore. In effect, "sweethearting" can cost businesses a relatively large amount of dollars each year.

There are various methods which attempt to prevent "sweethearting". For example, a first method involves using a smart detaching unit. The smart detaching unit is communicatively coupled to a Point Of Sale ("POS") terminal and configured to read RFID data from the RFID element of the EAS security tag. In this case, a detachment process is completed only if purchase of the item can be verified through the POS data (e.g., by determining if an identifier read from the RFID element matches an identifier stored in a database). The verification is facilitated by a controlled Radio Frequency ("RF") field produced around the smart detaching unit. The RFID data can only be read when the EAS security tag is placed into the smart detaching unit. This approach is efficient and practical for mechanical detaching of the security tag from the item. However, the smart detaching unit does not allow the required amount of control for the antenna of the RFID reader thereof. Therefore, the RFID data of an EAS security tag, which is merely in proximity to the smart detaching unit rather than actually in the smart detacher unit, may be erroneously read by the RFID reader of the smart detaching unit.

A second method which attempts to prevent "sweethearting" requires a store employee to manually verify that the item having the EAS security tag detached therefrom is really being purchased. As should be understood, such manual verification may be unreliable if the store employee is unscrupulous.

A third method which attempts to prevent "sweethearting" does not involve verifying that the pin has been removed from the EAS security tag, i.e., actually detached from the article being purchased. Instead, the third method involves determining that the EAS security tag is in a certain area of the retail store.

SUMMARY OF THE INVENTION

The present invention concerns implementing systems and methods for detaching a tag from an article. The tag may comprise an Electronic Article Surveillance ("EAS") tag. The methods comprise detecting when the tag is in proximity to a detaching unit. The detaching unit may comprise a magnetic or power detacher. Thereafter, it is verified that the article has been accepted for a purchase transaction or has been successfully purchased using information received from the tag. Such verification can involve obtaining an article identifier or a unique tag identifier from the tag via an Radio Frequency ("RF") communication. A tag body is mechanically coupled to the detaching unit when it has been verified that the article has been accepted for a purchase transaction or has been successfully purchase.

Next, the detaching unit detects when a pin of the tag is no longer in proximity thereto. In some scenarios, this detection is made when: a signal is no longer being generated by a non-linear electrical circuit disposed within or coupled directly to the pin; and/or a signal generated by an electrical circuit disposed within or coupled directly to the pin stops being received by the detaching unit. The non-linear electrical circuit may comprise a frequency mixer. The tag body is mechanically detached from the detaching unit when the pin is no longer in proximity to the detaching unit.

In those or other scenarios, the method further involves: supplying power to a field source of the detaching unit subsequent to when the tag body is mechanically coupled to the detaching unit; and discontinuing the supply of power to the field source when a detection is made that the pin is no longer in proximity to the detaching unit and prior to when the tag body is mechanically decoupled from the detaching unit. Additionally, the detaching unit may concurrently performing the following operations: producing at least one signal when the tag is in proximity to the detaching unit whereby an electrical circuit disposed within or coupled directly to the pin is caused to generate a response signal; and applying a magnetic field to the tag whereby the pin is released from a locking mechanism disposed within the tag body.

DESCRIPTION OF THE DRAWINGS

Embodiments will be described with reference to the following drawing figures, in which like numerals represent like items throughout the figures, and in which.

DETAILED DESCRIPTION OF THE INVENTION

Figure 1:
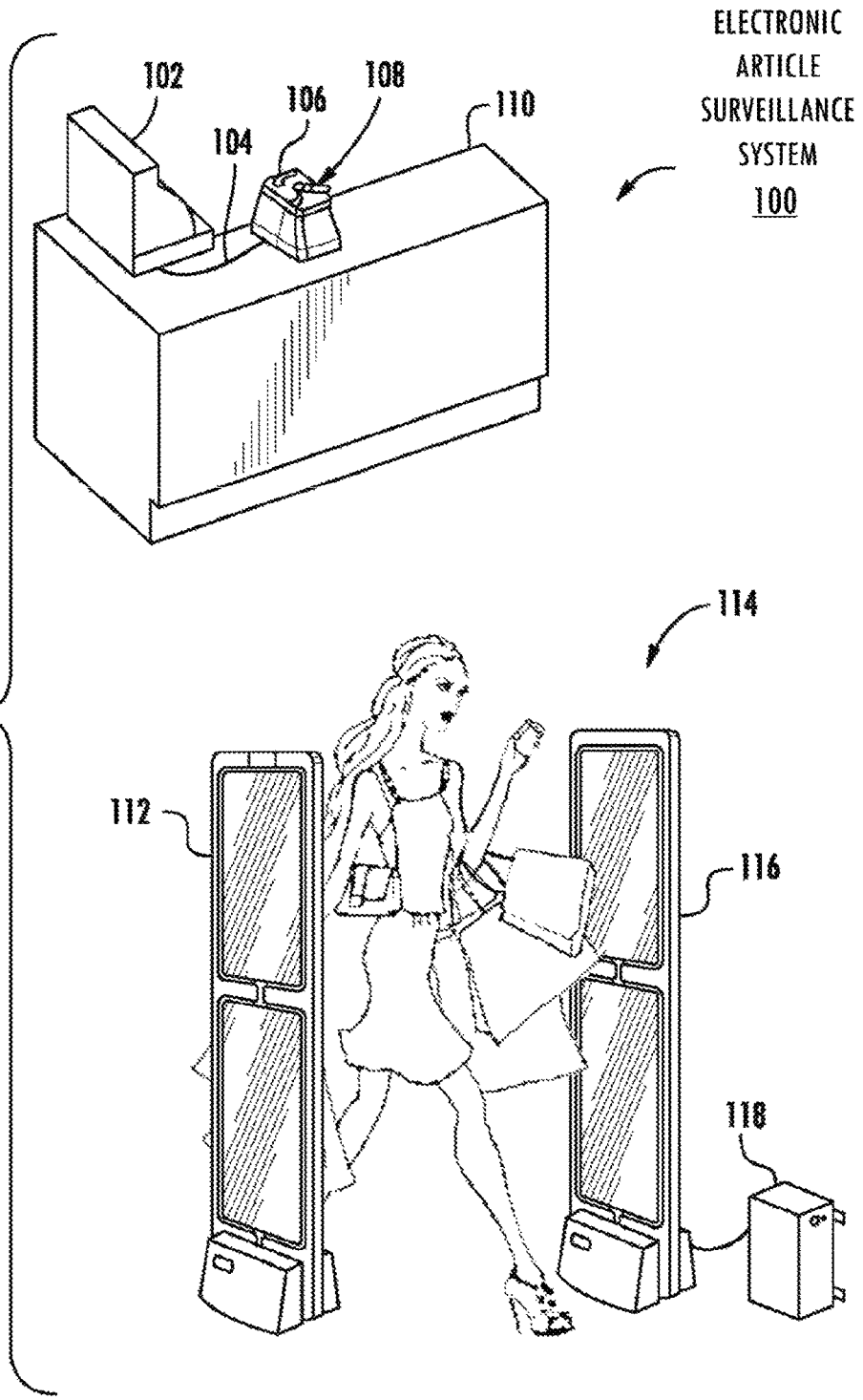
FIG. 1 is a schematic illustration of an exemplary architecture for an EAS system that is useful for understanding the present invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present solution will now be described with respect to FIGS. 1-17. The present solution generally relates to novel systems and methods for verifying a detachment of a security tag from an article. The methods comprise: detecting when the security tag is in proximity to a detaching unit; verifying that the article has been accepted for a purchase transaction or has been successfully purchased using information received from the tag; mechanically coupling the tag to the detaching unit when it has been verified that the article has been accepted for a purchase transaction or has been successfully purchased; detecting when a pin of the tag is no longer in proximity of the detaching unit; and mechanically decoupling the tag from the detaching unit when the pin is no longer in proximity to the detaching unit.

Referring now to FIG. 1, there is provided a schematic illustration of an exemplary EAS system 100 that is useful for understanding the present invention. EAS systems are well known in the art, and therefore will not be described in detail herein. Still, it should be understood that the present invention will be described herein in relation to an acousto-magnetic (or magnetostrictive) EAS system. Embodiments of the present invention are not limited in this regard. The EAS system 100 may alternatively include a magnetic EAS system, an RF EAS system, a microwave EAS system or other type of EAS system. In all cases, the EAS system 100 generally prevents the unauthorized removal of articles from a retail store, as well as the verification that pins have been removed from respective tag bodies of EAS security tags when removal of the corresponding articles from a retail store is authorized.

In this regard, EAS security tags 108 are securely coupled to articles (e.g., clothing, toys, and other merchandise) offered for sale by the retail store. Exemplary embodiments of the EAS security tags 108 will be described below in relation to FIGS. 3-11. At the exits of the retail store, detection equipment 114 sounds an alarm or otherwise alerts store employees when it senses an active EAS security tag 108 in proximity thereto. Such an alarm or alert provide notification to store employees of an attempt to remove an article from the retail store without proper authorization.

In some scenarios, the detection equipment 114 comprises antenna pedestals 112, 116 and an electronic unit 118. The antenna pedestals 112, 116 are configured to create a surveillance zone at the exit or checkout lane of the retail store by transmitting an EAS interrogation signal. The EAS interrogation signal causes an active EAS security tag 108 to produce a detectable response if an attempt is made to remove the article from the retail store. For example, the EAS security tag 108 can cause perturbations in the interrogation signal, as will be described in detail below.

The antenna pedestals 112, 116 may also be configured to act as RFID readers. In these scenarios, the antenna pedestals 112, 116 transmit an RFID interrogation signal for purposes of obtaining RFID data from the active EAS security tag 108. The RFID data can include, but is not limited to, a unique identifier for the active EAS security tag 108. In other scenarios, these RFID functions are provided by devices separate and apart from the antenna pedestals.

The EAS security tag 108 can be deactivated and detached from the article using a detaching unit 106. Typically, the EAS security tag 108 is removed or detached from the articles by store employees when the corresponding article has been purchased or has been otherwise authorized for removal from the retail store. The detaching unit 106 is located at a checkout counter 110 of the retail store and communicatively coupled to a POS terminal 102 via a wired link 104. In general, the POS terminal 102 facilitates the purchase of articles from the retail store.

Detaching units and POS terminals are well known in the art, and therefore will not be described herein. The POS terminal 102 can include any known or to be known POS terminal with or without any modifications thereto. However, the detaching unit 106 includes any known or to be known detaching unit selected in accordance with a particular application which has some hardware and/or software modifications made thereto so as to facilitate the implementation of the present invention (which will become more evident below).

In some cases, the detaching unit 106 is configured to operate as an RFID reader. As such, the detaching unit 106 may transmit an RFID interrogation signal for purposes of obtaining RFID data from an EAS security tag. Upon receipt of the tag's unique identifier and/or an article's identifier, the detaching unit 106 communicates the same to the POS terminal 102. At the POS terminal 102, a determination is made as to whether the received identifier(s) is(are) valid for an EAS security tag of the retail store. If it is determined that the received identifier(s) is(are) valid for an EAS security tag of the retail store, then the POS terminal 102 notifies the detaching unit 106 that the same has been validated, and therefore the EAS security tag 108 can be removed from the article.

Figure 2:
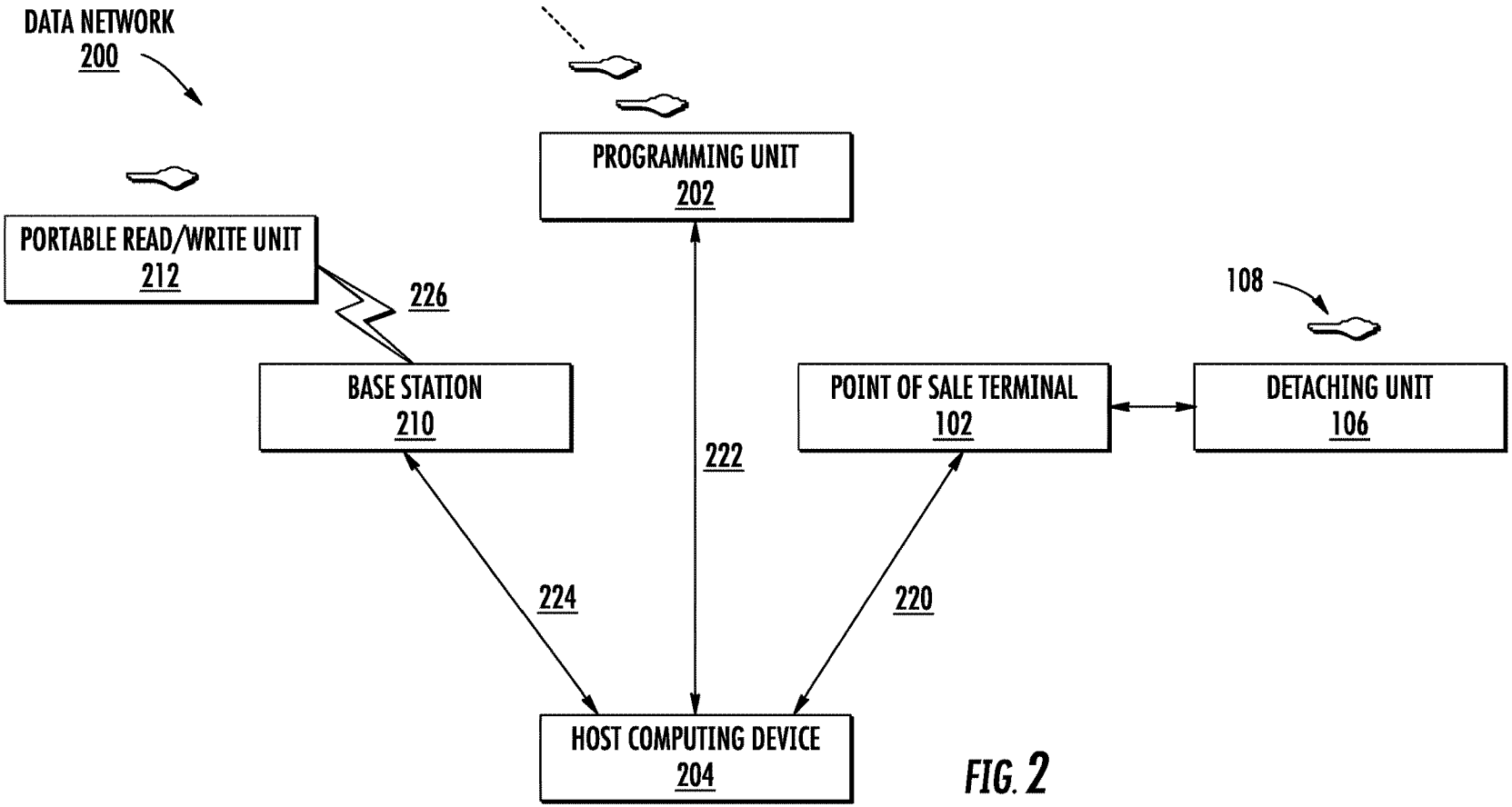
FIG. 2 is a schematic illustration of an exemplary architecture for a data network that is useful for understanding the present invention.

Referring now to FIG. 2, there is provided a schematic illustration of an exemplary architecture for a data network 200 in which the various components of the EAS system 100 are coupled together. Data network 200 comprises a host computing device 204 which stores data concerning at least one of merchandise identification, inventory, and pricing. A first data signal path 220 allows for two-way data communication between the host computing device 204 and the POS terminal 102. A second data signal path 222 permits data communication between the host computing device 204 and a programming unit 202. The programming unit 202 is generally configured to write product identifying data and other information into memory of the EAS security tag 108. A third data signal path 224 permits data communication between the host computing device 204 and a base station 210. The base station 210 is in wireless communication with a portable read/write unit 212. The portable read/write unit 212 reads data from the EAS security tags for purposes of determining the inventory of the retail store, as well as writes data to the EAS security tags. Data can be written to the EAS security tags when they are applied to articles of merchandise.

Figure 3:
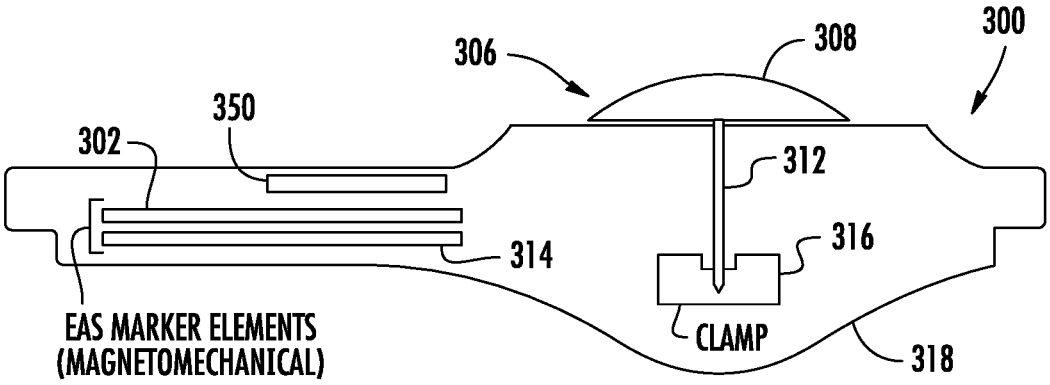
FIG. 3 is a cross sectional view of a first exemplary architecture for an EAS security tag shown that is useful for understanding the present invention.

Referring now to FIG. 3, there is provided a cross sectional view of an exemplary architecture for an EAS security tag 300. EAS security tag 108 can be the same as or similar the EAS security tag 300. As such, the discussion of EAS security tag 300 is sufficient to understand EAS security tag 108 of FIGS. 1-2.

As shown in FIG. 3, EAS security tag 300 comprises a housing 318 which is at least partially hollow. The housing 318 can be formed from a rigid or semi-rigid material, such as plastic. A pin (or tack) 306 is removably coupled to the housing 318. The pin 306 comprises a head 308 and a shaft 312. The shaft 312 is inserted into a recessed hole formed in the housing 318. The shaft 312 is held in position within the recessed hole via a locking (e.g., clamping) mechanism 316, which is mounted inside the housing 318. The locking mechanism 316 may include a mechanical locking mechanism (e.g., a clamp) and/or a magnetic locking mechanism (e.g., a clamp at least partially formed of a magnetic material).

A magnetostrictive active EAS element 314 and a bias magnet 302 are also disposed within the housing 318. These components 314, 302 may be the same as or similar to that disclosed in U.S. Pat. No. 4,510,489. In some scenarios, the resonant frequency of components 314, 302 is the same as the frequency at which the EAS system (e.g., EAS system 100 of FIG. 1) operates (e.g., 58 kHz). Additionally, the EAS element 314 is formed from thin, ribbon-shaped strips of substantially completely amorphous metal-metalloid alloy. The bias magnet 302 is formed from a rigid or semi-rigid ferromagnetic material. Embodiments are not limited to the particulars of these scenarios.

During operation, antenna pedestals (e.g., antenna pedestals 112, 116 of FIG. 1) of an EAS system (e.g., EAS system 100 of FIG. 1) emit periodic tonal bursts at a particular frequency (e.g., 58 kHz) that is the same as the resonance frequency of the amorphous strips (i.e., the EAS interrogation signal). This causes the strips to vibrate longitudinally by magnetostriction, and to continue to oscillate after the burst is over. The vibration causes a change in magnetism in the amorphous strips, which induces an AC voltage in an antenna structure (not shown in FIG. 3). The antenna structure (not shown in FIG. 3) converts the AC voltage into a radio wave. If the radio wave meets the required parameters (correct frequency, repetition, etc.), the alarm is activated.

A verification element 350 is also provided within the housing 318. The verification element 350 is generally configured to facilitate a determination as to whether the pin 306 is removed from the housing 318 during a POS transaction or other transaction in which removal of the EAS security tag from an article is authorized. In this regard, the verification element 350 is configured to act as a frequency mixer. Therefore, during the transaction, a detaching unit (e.g., detaching unit 106 of FIGS. 1-2) produces an RF field and an electrostatic field. These fields can be continuously produced by the detaching unit, or only when the security tag is in proximity to the detaching unit. In the later scenario, the detaching unit may comprise one or more proximity sensors (not shown) to detect when a security tag is in proximity thereto. The proximity sensors can include, but are not limited, to RFID enabled devices and/or depressible switches. In response to such detection, the detaching unit generates the RF field and electrostatic field.

In all scenarios, the RF field produced by the detaching unit is at a first frequency (e.g., 900 MHz). The electrostatic field is at a second frequency (e.g., 100 kHz). The first and second frequencies may be different from each other. For example, the first frequency may fall within the Ultra-high frequency band (e.g., 300 MHz-3 GHz), and the second frequency may fall within a different frequency band, such as the low RF frequency band (e.g., 30 kHz-300 kHz). An antenna structure (not shown in FIG. 3) of the verification element 350 is resonant at the first frequency (e.g., 900 MHz). If a non-linear element is placed across dipole antenna elements of the antenna structure, then the electrostatic field modulates the capacitance of the non-linear element. In effect, the non-linear element creates at least one response signal from mixing two signals applied thereto. Reception of the response signal by the detaching unit indicates that the pin 306 is still coupled to the housing 318 and in proximity to the detaching unit.

Figure 4:
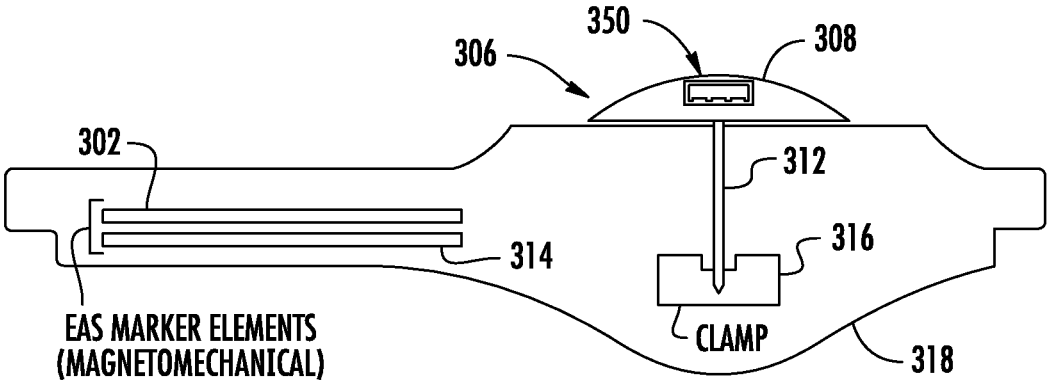
FIG. 4 is a cross sectional view of a second exemplary architecture for an EAS security tag that is useful for understanding the present invention.

Notably, the present invention is not limited to the architecture of EAS security tag 300 shown in FIG. 3. For example, in other scenarios, the verification element 350 may alternatively be disposed within the head 308 of the pin 306, as shown in FIG. 4.

Figure 5:
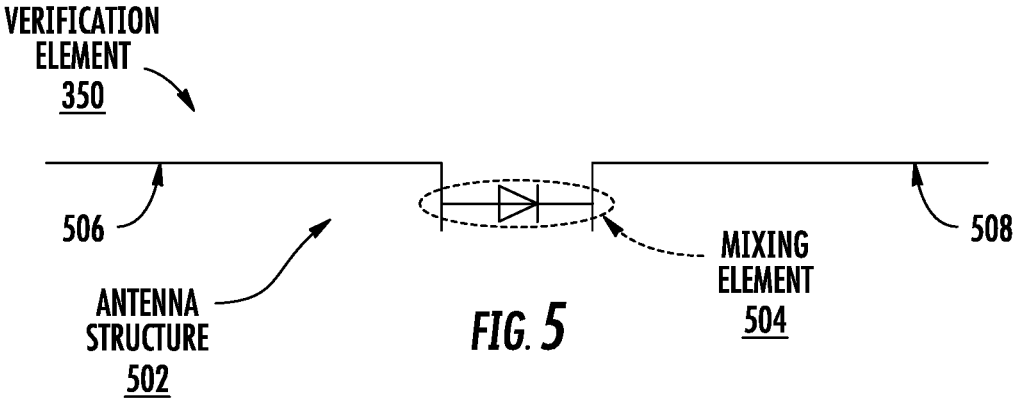
FIG. 5 is a schematic illustration of a first exemplary architecture for a security element of an EAS security tag that is useful for understanding the present invention.

Referring now to FIG. 5, there is provided a schematic illustration of an exemplary architecture for the verification element 350. The verification element 350 comprises an antenna structure 502 and a mixing element 504. The antenna structure 502 comprises dipole antenna elements 506, 508 collectively configured to operate at any desired frequency (e.g., 13.56 MHz or 915 MHz), which may be dependent on local government regulations.

The mixing element 504 is generally provided for allowing a detaching unit (e.g., detaching unit 106 of FIG. 1) to determine whether or not the pin 306 has been removed from the housing 318 of the EAS security tag 300. In this regard, the mixing element 504 comprises a non-linear element. The non-linear element 404 includes, but is not limited to, a diode as shown in FIG. 5 or a Metal-Oxide Semiconductor ("MOS") capacitor (not shown). During operation, the mixing element 504 responds to an RF field and an electrostatic field generated by a detaching unit (e.g., detaching unit 106 of FIG. 1), as described above. Briefly, the mixing element 504 generates at least one response signal from mixing the RF signal and the electrostatic signal applied thereto. Reception of the response signal by the detaching unit indicates that a pin is still coupled to a housing of an EAS security tag and in proximity to the detaching unit.

Figure 6:
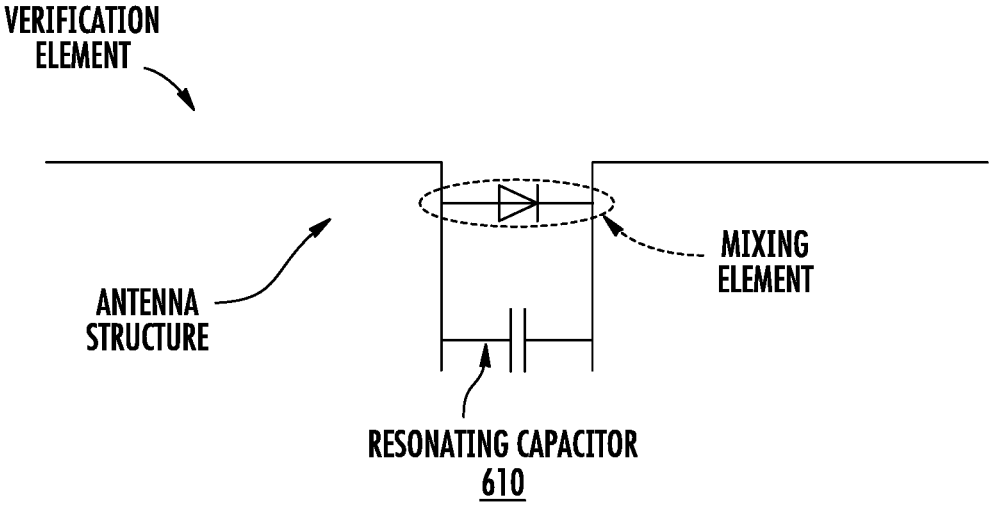
FIG. 6 is a schematic illustration of a second exemplary architecture for a security element of an EAS security tag that is useful for understanding the present invention.

Embodiments of the present invention are not limited to the verification element architecture shown in FIG. 5. For example, the antenna structure may additionally comprise a resonating capacitor 610, as shown in FIG. 6. In this case, the mixing element may be placed across or arranged in parallel with the resonating capacitor 610.

Figure 7:
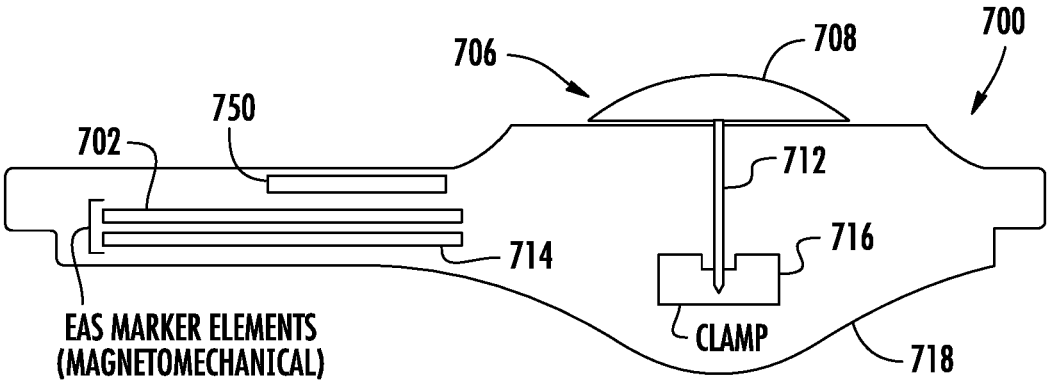
FIG. 7 is a cross sectional view of a third exemplary architecture for an EAS security tag that is useful for understanding the present invention.

As noted above, the EAS security tag may also comprise an RFID element. An exemplary architecture for an EAS security tag 700 with such an RFID element is schematically illustrated in FIG. 7. EAS security tag 108 of FIGS. 1-2 may be the same as or similar to EAS security tag 700. As such, the following discussion of EAS security tag 700 is sufficient for understanding EAS security tag 108 of FIGS. 1-2.

As shown in FIG. 7, the EAS security tag 700 comprises a housing 718 which is at least partially hollow. The housing 718 can be formed from a rigid or semi-rigid material, such as plastic. A pin 706 is removably coupled to the housing 718. The pin 706 comprises a head 708 and a shaft 712. The shaft 712 is inserted into a recessed hole formed in the housing 718. The shaft 712 is held in position within the recessed hole via a locking (e.g., clamping) mechanism 716, which is mounted inside the housing 718.

A magnetostrictive active EAS element 714 and a bias magnet 702 are also disposed within the housing 718. These components 714, 702 may be the same as or similar to that disclosed in U.S. Pat. No. 4,510,489. In some scenarios, the resonant frequency of components 714, 702 is the same as the frequency at which the EAS system (e.g., EAS system 100 of FIG. 1) operates (e.g., 58 kHz). Additionally, the EAS element 714 is formed from thin, ribbon-shaped strips of substantially completely amorphous metal-metalloid alloy. The bias magnet 702 is formed from a rigid or semi-rigid ferromagnetic material. Embodiments are not limited to the particulars of these scenarios.

During operation, antenna pedestals (e.g., antenna pedestals 112, 116 of FIG. 1) of an EAS system (e.g., EAS system 100 of FIG. 1) emit periodic tonal bursts at a particular frequency (e.g., 58 kHz) that is the same as the resonance frequency of the amorphous strips (i.e., the EAS interrogation signal). This causes the strips to vibrate longitudinally by magnetostriction, and to continue to oscillate after the burst is over. The vibration causes a change in magnetism in the amorphous strips, which induces an AC voltage in an antenna structure (not shown in FIG. 3). The antenna structure (not shown in FIG. 3) converts the AC voltage into a radio wave. If the radio wave meets the required parameters (correct frequency, repetition, etc.), the alarm is activated.

A hybrid verification element 750 is also provided within the housing 718. The hybrid verification element 750 is generally configured to: (1) validate RFID data stored on the hybrid verification element 750; and (2) facilitate a determination as to whether the pin 706 is removed from the housing 718 during a POS transaction or other transaction in which removal of the EAS security tag from an article is authorized.

With regard to function (1), the hybrid verification element 750 is configured to respond to an RFID interrogation signal. For example, in response to the reception of an RFID interrogation signal, the hybrid verification element 750 transmits the RFID data to the source of the RFID interrogation signal, such as the detaching unit 106 of FIGS. 1-2. Upon receipt of the RFID data, the source communicates the same to a POS terminal (e.g., POS terminal 102 of FIG. 1). At the POS terminal, a determination is made as to whether the RFID data is valid for an EAS security tag of the retail store. If it is determined that the RFID data is valid RFID data for an EAS security tag of the retail store, then the POS terminal notifies the source that the RFID data has been validated, and therefore the EAS security tag 108 can be removed from the article.

With regard to function (2), the hybrid verification element 750 is configured to act as a frequency mixer. In this regard, the hybrid verification element 750 acts similar to or the same as the verification element 350 described above. Accordingly, a non-linear element of the hybrid verification element 750 creates at least one response signal from mixing an RF signal and an electrostatic signal applied thereto. Reception of the response signal by the detaching unit indicates that the pin 706 is still coupled to the housing 718.

Figure 8:
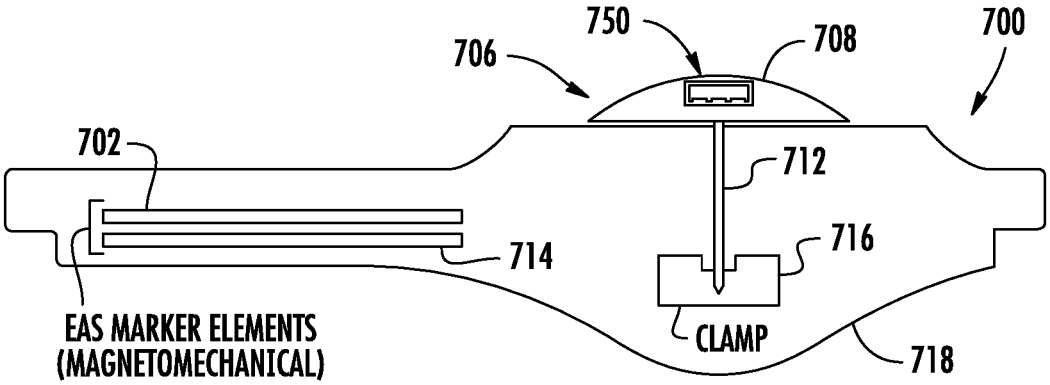
FIG. 8 is a cross sectional view of a fourth exemplary architecture for an EAS security tag that is useful for understanding the present invention.
Figure 11:
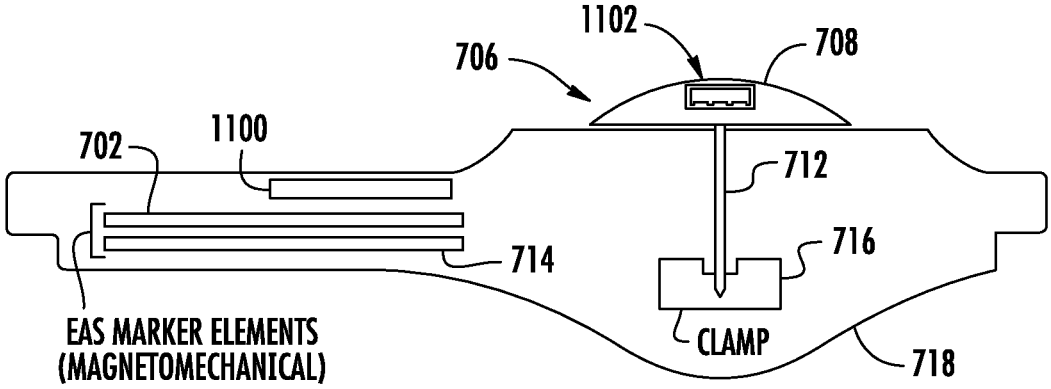
FIG. 11 is a cross sectional view of a fifth exemplary architecture for an EAS security tag that is useful for understanding the present invention.

Notably, the present invention is not limited to the architecture of EAS security tag 700 shown in FIG. 7. For example, in other scenarios, the hybrid verification element 750 may alternatively be disposed within the head 708 of the pin 706, as shown in FIG. 8. Alternatively, an RFID portion 1100 of the hybrid verification element can be disposed in the housing 718 of the EAS security tag and a mixing portion 1102 of the hybrid verification element can be disposed in the head 708 of the pin 706 (or vice versa), as shown in FIG. 11.

Figure 9:
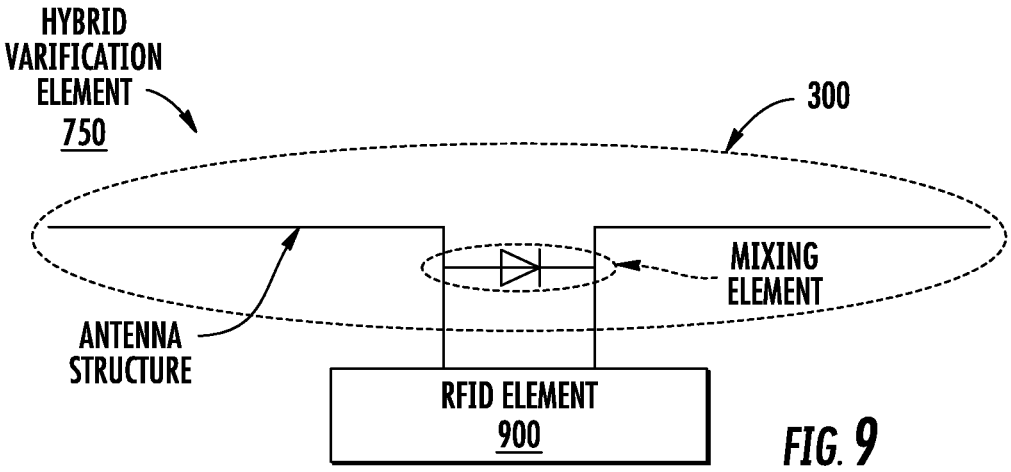
FIG. 9 is a schematic illustration of a first exemplary architecture for a hybrid security element of an EAS security tag that is useful for understanding the present invention.
Figure 10:
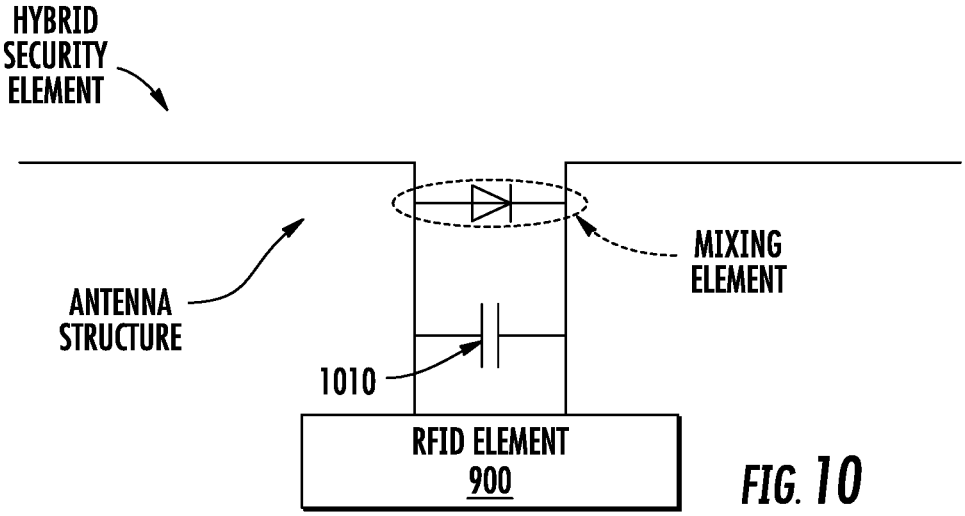
FIG. 10 is a schematic illustration of a second exemplary architecture for a hybrid security element of an EAS security tag that is useful for understanding the present invention.

Referring now to FIG. 9, there is provided a schematic illustration of an exemplary architecture for the hybrid verification element 750. The hybrid verification element 750 comprises the verification element 300 of FIG. 3 and an RFID element 900. As described above, the verification element 300 comprises a mixing element. The mixing element is disposed across or arranged in parallel with the RFID element 900. Embodiments of the present invention are not limited to the hybrid verification element architecture shown in FIG. 9. For example, the antenna structure may additionally comprise a resonating capacitor 1010, as shown in FIG. 10. In this case, the mixing element may be placed across or arranged in parallel with the resonating capacitor 1010.

The RFID element 900 is configured to act as a transponder in connection with the article identification aspects of the EAS system (e.g., EAS system 100 of FIG. 1). In this regard, the RFID element 900 stores multi-bit identification data and emits an identification signal corresponding to the stored multi-bit identification data. The identification signal is emitted in response to the reception of the RFID interrogation signal (e.g., the RFID interrogation signal transmitted from the antenna pedestals 112, 116 and/or the detaching unit 106 of FIG. 1). In some scenarios, the transponder circuit of the RFID element 900 is the model 210 transponder circuit available from Gemplus, Z. I. Athelia III, Voie Antiope, 13705 La Ciotat Cedex, France. The model 210 transponder circuit is a passive transponder which operates at 13 MHz and has a considerable data storage capability.

Figure 12:
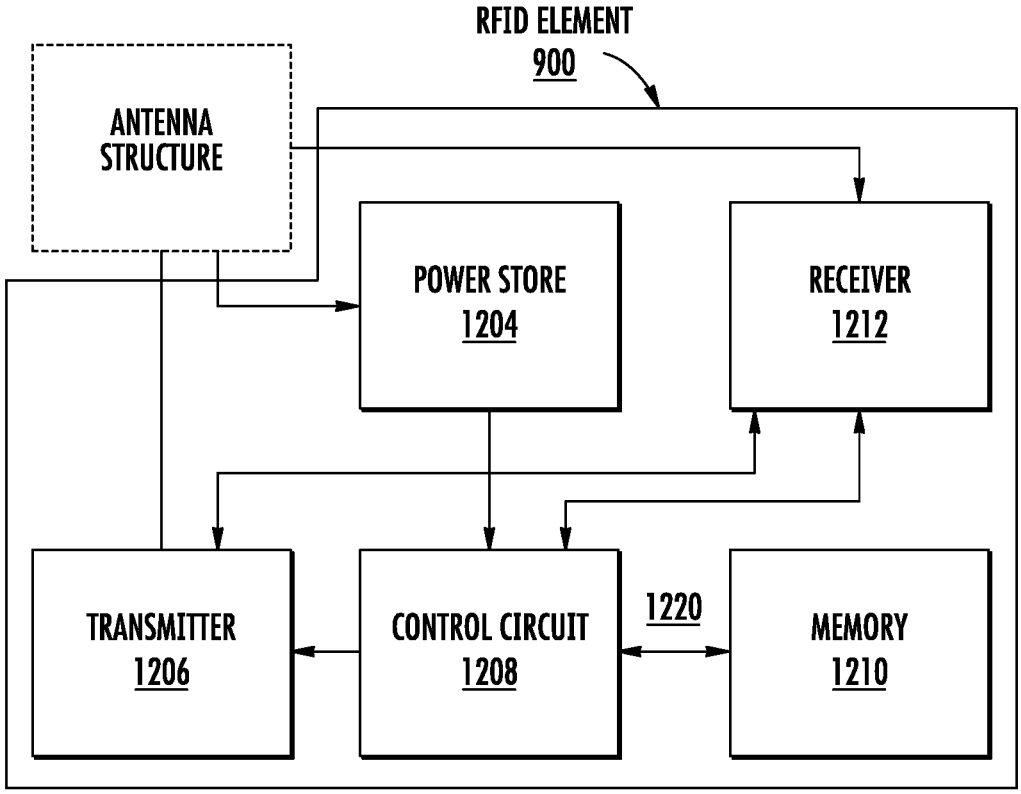
FIG. 12 is a block diagram of an exemplary hardware architecture for a hybrid security element that is useful for understanding the present invention.

Referring now to FIG. 12, there is provided a block diagram of an exemplary architecture for the RFID element 900. The RFID element 900 may include more or less components than those shown in FIG. 12. However, the components shown are sufficient to disclose an illustrative embodiment implementing the present invention. Some or all of the components of the RFID element 900 can be implemented in hardware, software and/or a combination of hardware and software. The hardware includes, but is not limited to, one or more electronic circuits. The hardware includes, but is not limited to, one or more electronic circuits. The electronic circuits can include, but are not limited to, passive components (e.g., resistors and capacitors) and/or active components (e.g., amplifiers and/or microprocessors). The passive and/or active components can be adapted to, arranged to and/or programmed to perform one or more of the methodologies, procedures, or functions described herein.

The RFID element 900 comprises a power store 1204, a transmitter 1206, a control circuit 1208, memory 1210 and a receiver 1212. Notably, components 1204, 1206 and 1212 are coupled to an antenna structure when implemented in the hybrid verification element 750. As such, an antenna structure is shown in FIG. 12 as being external to the RFID element 900. The antenna structure is tuned to receive a signal that is at an operating frequency of the EAS system (e.g., EAS system 100 of FIG. 1). For example, the operating frequency to which the antenna structure is tuned may be 13 MHz.

The control circuit 1208 controls the overall operation of the RFID element 900. Connected between the antenna structure and the control circuit 1208 is a receiver 1212. The receiver 1212 captures data signals carried by a carrier signal to which the antenna structure is tuned. In some scenarios, the data signals are generated by on/off keying the carrier signal. The receiver 1212 detects and captures the on/off keyed data signal.

Also connected between the antenna structure and the control circuit 1208 is the transmitter 1206. The transmitter 1206 operates to transmit a data signal via the antenna structure. In some scenarios, the transmitter 1206 selectively opens or shorts at least one reactive element (e.g., reflectors and/or delay elements) in the antenna structure 602 to provide perturbations in an RFID interrogation signal, such as a specific complex delay pattern and attenuation characteristics. The perturbations in the interrogation signal are detectable by an RFID reader (e.g., the detection equipment 114 of FIG. 1).

The control circuit 1208 may store various information in memory 1210. Accordingly, the memory 1210 is connected to and accessible by the control circuit 1208 through electrical connection 1220. The memory 1210 may be a volatile memory and/or a non-volatile memory. For example, memory 1212 can include, but is not limited to, a Radon Access Memory ("RAM"), a Dynamic RAM ("DRAM"), a Read Only Memory ("ROM") and a flash memory. The memory 1210 may also comprise unsecure memory and/or secure memory. The memory 1210 can be used to store identification data which may be transmitted from the RFID element 900 via an identification signal. The memory 1210 may also store other information received by receiver 1212. The other information can include, but is not limited to, information indicative of the handling or sale of an article.

The power store 1204 is connected to the antenna structure and accumulates power from a signal induced in the antenna structure as a result of the reception of the RFID interrogation signal by the RFID element 900. The power store 1204 is configured to supply power to the transmitter 1206, control circuit 1208, and receiver 1212. The power store 1204 may include, but is not limited to, a storage capacitor.

Figure 13:
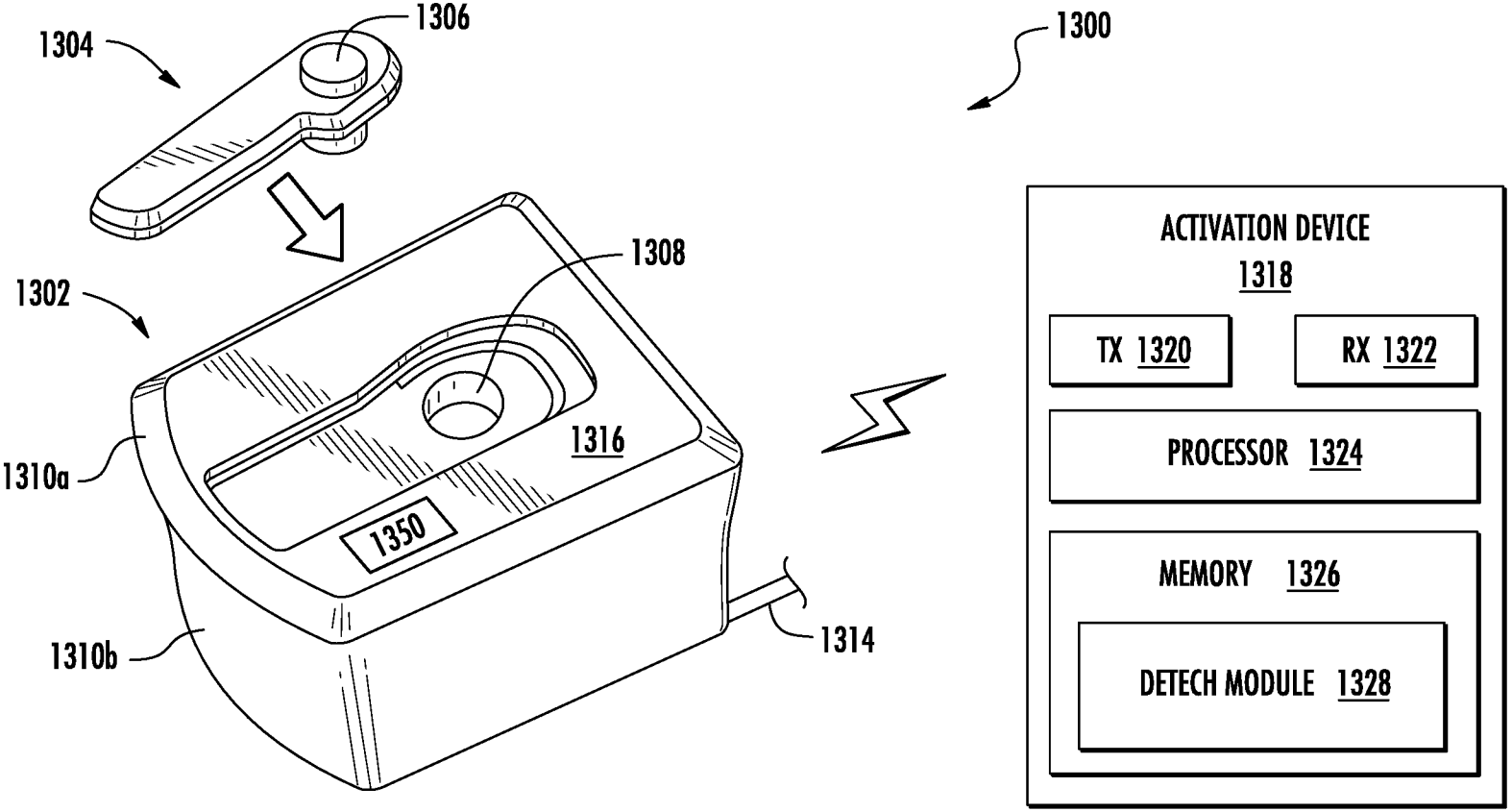
FIG. 13 is a schematic illustration of an EAS security tag and a detaching unit that is useful for understanding the present invention.

Referring now to FIG. 13, there is provided a schematic illustration of an exemplary system 1300 that is useful for understanding the present invention. System 1300 comprises a detaching unit 1302. The detaching unit 106 of FIG. 1 can be the same as or similar to detaching unit 1302. As such, the following discussion of detaching unit 1302 is sufficient for understanding the detaching unit 106 of FIG. 1.

The detaching unit 1302 comprises a housing having first housing portion 1310*a* and second housing portion 1310*b* (collectively referred to as "housing 1310"). Housing 1310 contains elements of the detaching unit 1302 as described in detail with respect to FIG. 14. Housing 1310 includes a first side 1316 that has a receiving portion 1308. The receiving portion 1308 is sized and shaped to receive at least a portion of an EAS security tag 1304. Receiving portion 1308 helps position the EAS security tag 1304 in the proper location for detachment.

The detaching unit 1302 further comprises a power connection 1314 to a power source. The power source provides power to the detaching unit 1302. Additionally or alternatively, the detaching unit 1302 may include an internal battery power source.

The EAS security tag 1304 is configured to be releasably attached to an article or item as described above. The EAS security tag 1304 has a magnetic locking mechanism (not shown in FIG. 13) disposed therein. In some scenarios, the magnetic locking mechanism includes, but is not limited to, a clamp. The magnetic locking mechanism is generally configured to (a) releasably engage a pin (or tack) 1306 when inserted into the EAS security tag 1304 and (b) disengage the pin (or tack) 1306 when exposed to a magnetic detaching field.

An activation device 1318 is provided for controlling operations of the detaching unit 1302. In this regard, the activation device 1318 comprises a transmitter 1320, a receiver 1322, a processor 1324 in communication with transmitter 1320 and receiver 1322, and a memory 1326 in communication with processor 1324. These components 1320-1326 facilitate communication with detaching unit 1302 and/or other devices.

Memory 1326 may include non-volatile and volatile memory. For example, non-volatile memory may include a hard drive, flash memory, memory stick and the like. The volatile memory may include Random Access Memory ("RAM") and others known in the art. Memory 1326 may store program instructions for detach module 1328. When executed, such instructions cause processor 1324 to perform a detacher activation process which will be discussed below in detail. Still, it should be understood that in some scenarios the detacher activation process involves activating the detaching unit 1302 by energizing power connection 1314.

Figure 14:
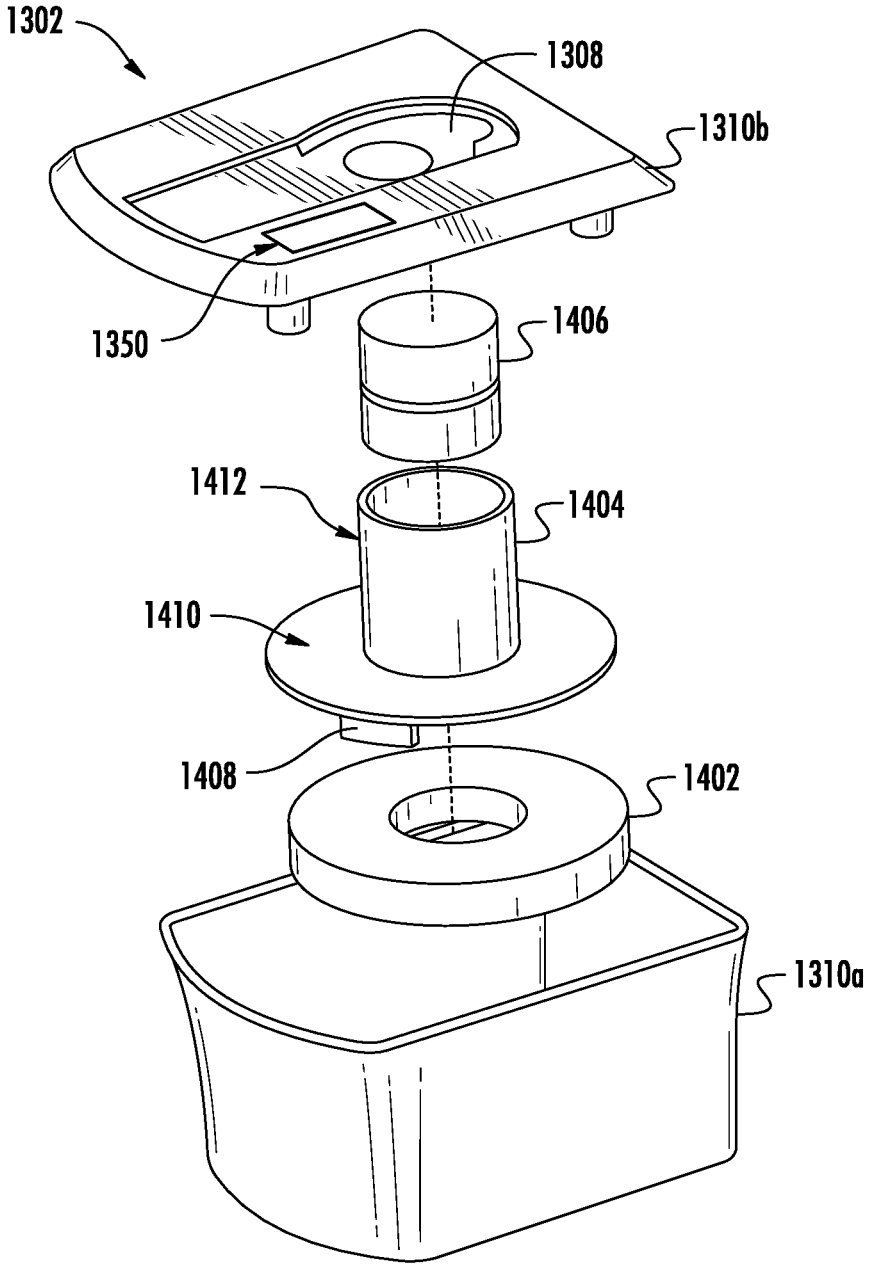
FIG. 14 is an exploded view of the detaching unit shown in FIG. 13.

An exploded view of the detaching unit 1302 is provided in FIG. 14. As shown in FIG. 14, the detaching unit 1302 comprises the housing 1310 in which a plurality of components are disposed. These components include, but are not limited to, a field source 1402, a guide 1404 and a magnet 1406.

The field source 1402 provides a first magnetic field (e.g., magnetic field 1602 shown in FIG. 16) when power is applied to the field source 1402. For example, the field source 1402 may be an air core coil that provides the first magnetic field with sufficient field strength to lift or move the magnet 1406 when power is applied thereto. In other words, the field source 1402 is a magnetic field source that can be (a) turned on by applying power thereto and (b) turned off by ceasing power application thereto. Alternatively, the field source 1402 may be a solenoid that is arranged to physically push magnet by providing the first magnetic field when power is applied thereto. The position of field source 1402 is substantially fixed within the housing 1310 so as to prevent movement of the field source 1402 and to help keep the guide 1404 coaxial with the field source 1402.

The guide 1404 includes a planar element 1410 that is positioned co-axial with the field source 1402. The planar element 1410 includes a retaining element 1408 that maintains the guide 1404 in a coaxial relationship with the field source 1402 in order to prevent movement of the planar element 1410 in a direction off of an axis (e.g., axis 1504 of FIG. 14) while disposed on the field source 1402. At least a portion of the planar element 1410 is formed of a magnetic material that attracts the magnet 1406 thereto. This magnetic attraction facilitates the securement of the magnet 1406 in a non-detach position shown in FIG. 15 when the field source 1402 is unpowered. The field source 1402 may also have a base magnetic field (not shown) that attracts the magnet 1406 thereto.

The guide 1404 further includes a conduit 1412 disposed on and perpendicular to the planar element 1410. The conduit 1412 (a) retains the magnet 1406 within the detaching unit 1302 and (b) slidingly directs movement of the magnet 1406 along the axis (e.g., axis 1504 of FIG. 15). The conduit 1412 is positioned substantially over the core of an air coil magnet. The magnet 1406 is a permanent magnet that provides a second magnetic field (e.g., magnetic field 1506 of FIG. 15). The second magnetic field causes the magnetic locking mechanism in the EAS security tag 1304 to release the pin (or tack) 1306 so that the EAS security tag 1304 may be removed from an article.

Figure 15:
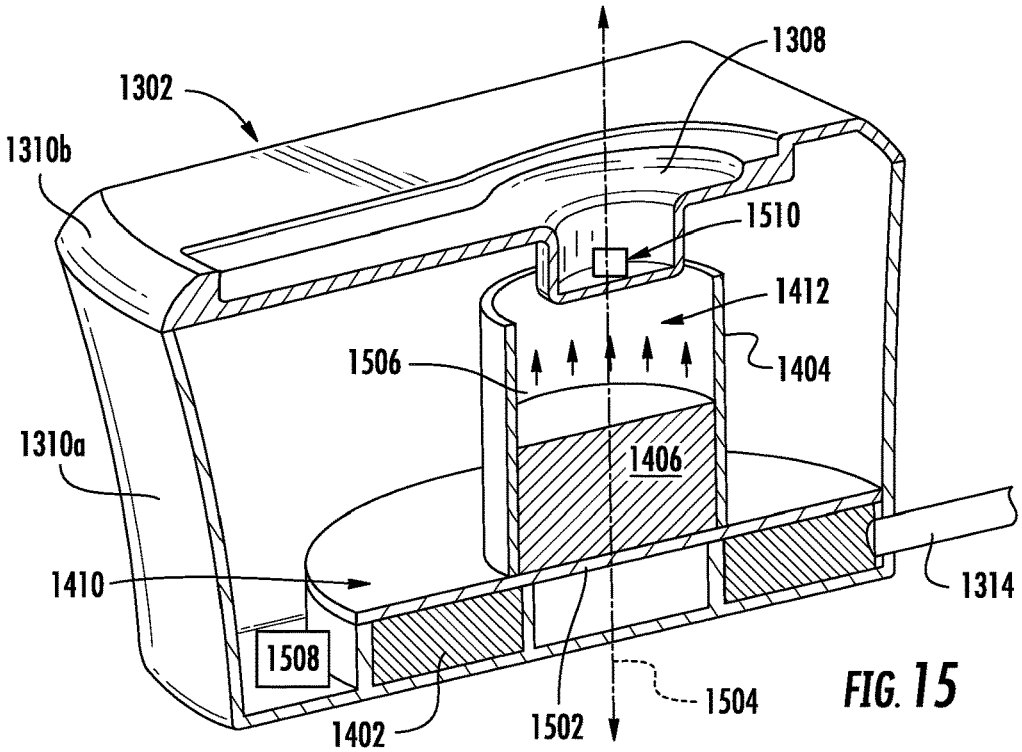
FIG. 15 is a cross-sectional view of the detaching unit shown in FIGS. 13-14 with the magnet in it's non-detach position.

Referring now to FIG. 15, there is provided a cross-sectional view of the detaching unit 1302 with the magnet 1406 in its non-detach position. The magnet 1406 and guide 1404 are disposed within the housing 1310 of the detaching unit 1302. The planer element 1410 is disposed on or positioned over the field source 1402 such that the conduit 1412 is positioned coaxial with the field source. The magnet 1406 is positioned at the end of the conduit 1412 against a stop 1502 before power is applied to the field source 1402. The stop 1502 prevents the magnet 1406 from moving into an opening formed in the field source 1402.

Figure 16:
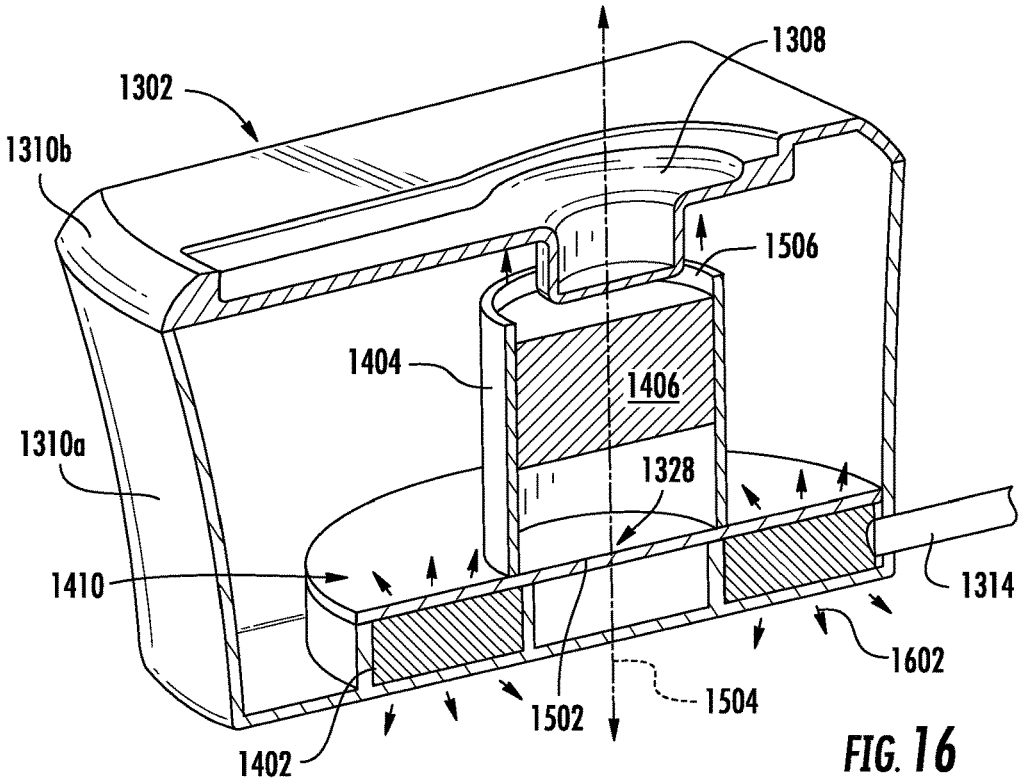
FIG. 16 is a cross-sectional view of the detaching unit shown in FIGS. 13-14 with the magnet in it's detach position.

Referring now to FIG. 16, there is provided a cross-sectional view of the detaching unit 1302 with the magnet 1406 in it's detach position. Power is applied to the field source 1402 such that field source 1402 generates the first magnetic field 1602. The first magnetic field 1602 moves the magnet 1406 into it's detach position. In this regard, it should be understood that the first magnetic field 1602 has a strength sufficient to overcome gravity and the magnetic attraction between the magnet 1406 and the planar element 1410 such that magnet 1406 is moved within conduit 1412 in a direction towards the receiving portion 1308. The magnet 1406 transitions from it's detach position to it's non-detach position when the field source 1402 is unpowered and the EAS security tag 1304 is no longer inserted in receiving portion 1308.

Notably, the detaching unit 1302 comprises a field generator 1508. The field generator 1508 is configured to generate an RF field and an electrostatic field to which a verification element (e.g., verification element 350 of FIG. 3-4 or 750 of FIGS. 7-8) of the EAS security tag 1304 can respond. These fields can be continuously produced by the field generator 1508, or only when the security tag is in proximity to the detaching unit 1302. In the later scenario, the detaching unit 1302 may comprise one or more proximity sensors 1510 to detect when a security tag is in proximity thereto. The proximity sensors can include, but are not limited to, RFID enabled devices and/or depressible switches. In response to such detection, the detaching unit generates the RF field and electrostatic field.

The verification element of the EAS security tag 1304 comprises a mixing element (e.g., mixing element 504 of FIG. 5). The mixing element is generally provided for allowing a determination to be made by the detaching unit 1302 as to whether or not a pin (e.g., pin 306 of FIG. 3 or pin 1306 of FIG. 13) has been removed from a housing (e.g., housing 318 of FIG. 3 or housing 1310 of FIG. 13) of the EAS security tag 1304. Accordingly, the mixing element comprises a non-linear element.

During operation, the mixing element responds to the RF field and the electrostatic field generated by the detaching unit 1302. More specifically, the mixing element generates at least one response signal from mixing the RF signal and the electrostatic signal applied thereto. Reception of the response signal by the detaching unit 1302 indicates that a pin (or tack) is still coupled to a housing of an EAS security tag 1304 (or stated differently, that both the housing and pin of the EAS security tag 1304 are still present within the receiving portion 1308).

During a detaching process, the EAS security tag 1304 is detached from the article by decoupling of the pin (or tack) from the housing thereof. The detaching process is typically performed as part of an article purchase process. The detaching process involves releasing the pin (or tack) via application of a magnetic field 1506 by the magnet 1406. The magnet 1406 is normally in a non-detach position (shown in 15) within the detaching unit 1302. Upon being exposed to a first magnetic field 1602, the magnet 1406 is caused to travel from the non-detach position shown in FIG. 15 to a detach position shown in FIG. 16 so as to release the EAS security tag's locking mechanism (e.g., a clamp). The pin (or tack) can now be removed from the EAS security tag 1304. Once the pin (or tack) is removed, the pin (or tack) can be decoupled from the article.

When the pin is separated from the housing and removed a certain distance from the detaching unit 1302, the mixing element ceases generating the response signal, thereby indicating that the pin (or tack) has actually been decoupled from housing of the EAS security tag 1304 and verifying the customer's intent to purchase the article. Once the response signal goes away, the purchase of the article can be verified. In response to this verification, the RFID reader communicates RFID data to a POS terminal 102 so that the purchase transaction can be completed.

Referring now to FIG. 8, there is provided an exemplary method 1700 for verifying a detachment of an EAS security tag (e.g., EAS security tag 300 of FIG. 3, 700 of FIG. 7, or 1304 of FIG. 13) from an article. The method 1700 begins with step 1702 and continues with step 1704. In step 1704, a payment transaction for at least one article is completed. In some scenarios, method 1700 can be performed prior to the completion of a payment transaction. In this case, step 1704 would alternatively involve simply accepting the article for a purchase transaction (i.e., scanning a barcode coupled to the article so as to enter information therefore into a POS system during a payment transaction). Payment transactions are well known in the art, and therefore will not be described herein. Next, operations are performed for detaching the EAS security tag from the article. These operations will now be described in relation to steps 1706-1730.

In step 1706, at least a portion of the EAS security tag is received within a receiving portion (e.g., receiving portion 1308 of FIG. 13) of a detaching unit (e.g., detaching unit 1302 of FIG. 13). Next, a determination is made that a detach sequence should be initiated a shown by step 1708. This determination can be made by a processor (e.g., processor 1324 of FIG. 13) of an activation device (e.g., activation device 1318 of FIG. 13). The determination is made based on whether or not the EAS security tag has been removably inserted into a receiving portion (e.g., receiving portion 1308 of FIG. 13) of a detaching unit (e.g., detaching unit 1302 of FIG. 13). A proximity or other sensor (e.g., sensor 1510 of FIG. 15) disposed within the detaching unit can determine when the EAS security tag has been placed into the receiving portion. Additionally or alternatively, the detaching unit may initiate the detach sequence when triggered by an employee and/or POS terminal.

In a next step 1710, operations are performed by the detaching unit to identify the EAS security tag and/or the article to which the EAS security tag is attached. These operations can involve performing RF communications with the EAS security tag to obtain a tag's unique identifier and/or an article identifier therefrom. The tag's unique identifier and/or article identifier is(are) then communicated to a POS terminal 102 in step 1712. The POS terminal 102 uses the identifier(s) to verify that (a) the article was successfully purchased via the completed purchase transaction or (b) the article has been accepted for a purchase transaction. Such verification can be made by: comparing the tag's unique identifier to tag identifiers associated with article to be purchased or have already been purchased; and/or comparing the article identifier with article identifiers of items to be purchase or have already been purchased via the completed purchase transaction. If a match is found, then it is concluded that the article was indeed successfully purchased or was indeed accepted for a purchase transaction.

When such verification is made, step 1716 is performed where the EAS security tag is securely coupled to the detaching unit. The EAS security tag can be securely coupled to the detaching unit by a mechanical coupling mechanism (e.g., mechanical latch 1350 of FIG. 13). Subsequently, steps 1718-1720 are performed concurrently with steps 1722-1728.

Steps 1718-1720 involve: producing by the detaching unit first and second signals; and generating by a non-linear electrical circuit (e.g., mixing element 504 of FIG. 5) of the EAS security tag a third signal from the first and second signals applied thereto. The first signal has a first frequency (e.g., 900 MHz) and the second signal has a second frequency (e.g., 100 kHz) different from the first frequency. In some scenarios, the first signal is an RF signal and the second signal is an electrostatic signal. In some scenarios, the non-linear electrical circuit includes, but is not limited to, a diode or a capacitor placed across two dipole antenna elements (e.g., antenna elements 506 and 508 of FIG. 5) and/or a resonating capacitor (e.g., capacitor 610 of FIG. 6) of an antenna structure.

Steps 1718-1726 involve: supplying power to a field source (e.g., field source 1402 of FIG. 14) of the detaching unit; generating a first magnetic field (e.g., magnetic field 1602 of FIG. 16) by the field source; and applying a second magnetic field (e.g., magnetic field 1506 of FIG. 15) by a magnet (e.g., magnet 1406 of FIG. 14) of the detaching unit to the EAS security tag disposed in the receiving portion of the detaching unit. The second magnetic field causes a magnetic locking mechanism (e.g., clamp 316 of FIG. 3) in the EAS security tag to release the pin (or tack) so that the pin (or tack) may be removed from a tag body (e.g., tag body 318 of FIG. 3) of the EAS security tag, as shown by steps 1728-1730.

Figure 17A:
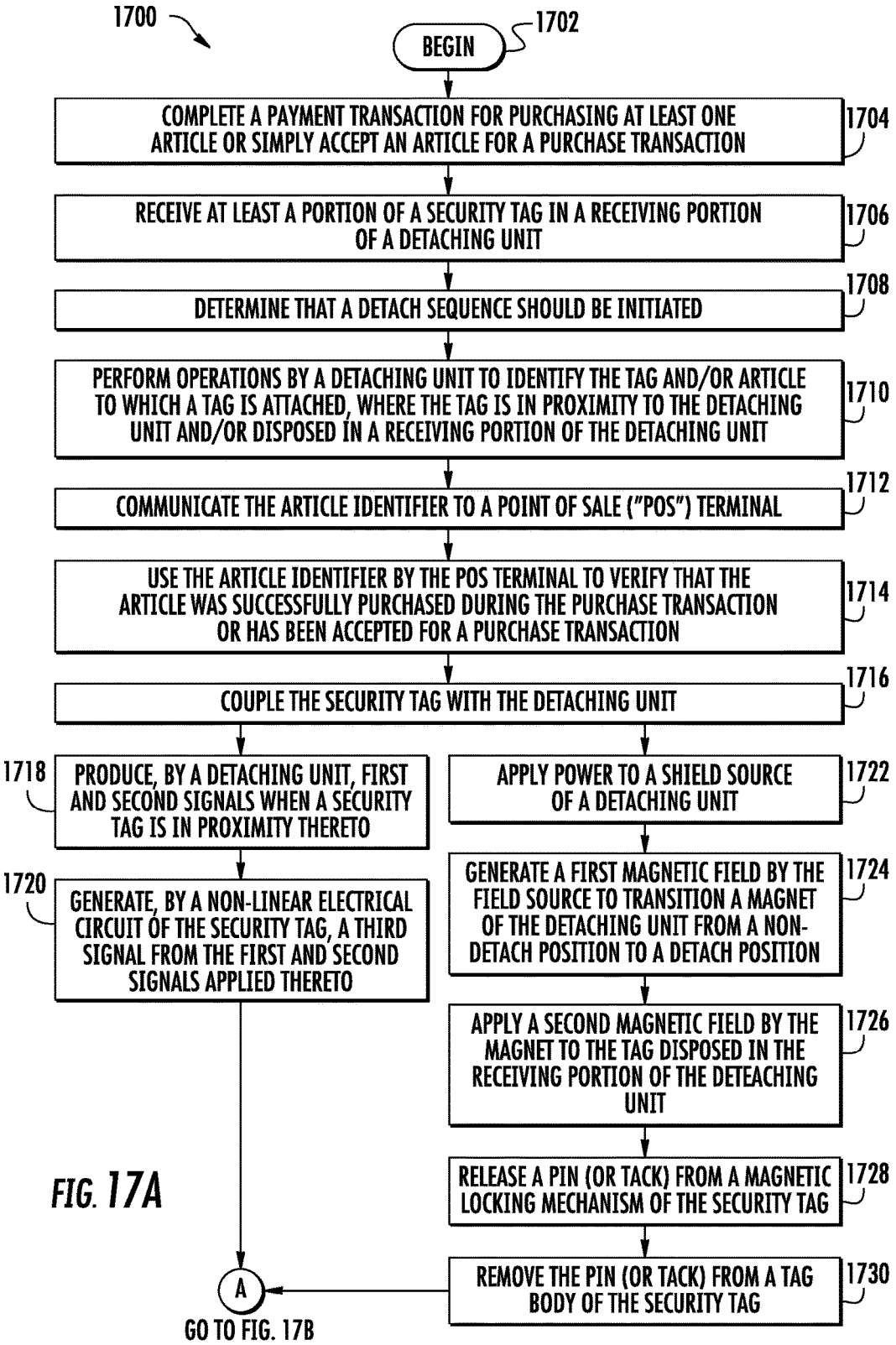
FIGS. 17A-17B (collectively referred to as "FIG. 17") is a flow diagram of an exemplary method for verifying a detachment of an EAS security tag from a given article that is useful for understanding the present invention.
Figure 17B:
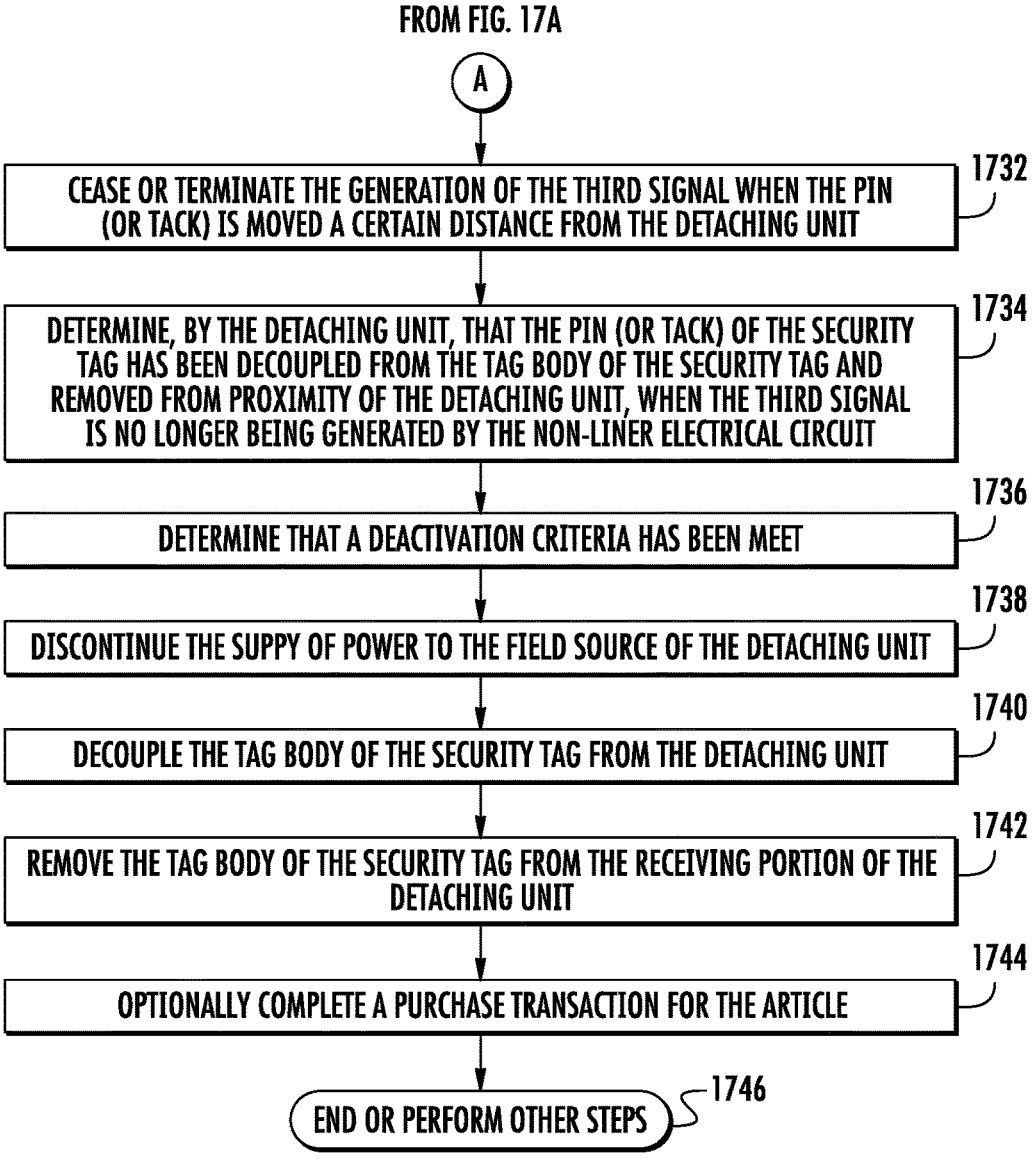

Upon completing step 1730, method 1700 continues with step 1732 of FIG. 17B. As shown by step 1730, the generation of the third signal is ceased or terminated when the pin (or tack) of the security tag is moved a certain distance from the detaching unit. For example, if the non-linear electrical circuit is disposed in a pin head (e.g., pin head 308 of FIG. 3) of the security tag, then it would stop generating the third signal when the pin (e.g., pin 306 of FIG. 3) is removed from the tag body (e.g., tag body 318 of FIG. 3) and placed a certain distance from the tag body (which is not in proximity to the detaching unit). When the third signal is no longer being generated by the non-linear electrical circuit, the detaching unit makes a determination in step 1734 that the pin (or tack) of the security tag has been (a) decoupled from the tag body of the EAS security tag and (b) removed from proximity of the detaching unit.

Next in step 1736, a determination is made that a deactivation criterion is met. The deactivation criterion includes one or more rules that, when met, cause the processor of the activation device to discontinue the supply of power to the field source of the detaching unit. In some scenarios, the deactivation criterion is met when the generation of the third signal by the EAS security tag has stopped. When such a determination is made, the processor of the activation device performs operations to discontinue the supply of power to the field source of the detaching unit.

Once power is no longer supplied to the field source, the tag body of the EAS security tag is decoupled from the detaching unit, as shown by step 1740. This decoupling can involve actuating the mechanical coupling mechanism (e.g., mechanical latch 1350 of FIG. 13) of the detaching unit. For example, a mechanical latch can be actuated so that the tag body is no longer mechanically latched or fastened to the detaching unit. At this time, the tag body of the EAS security tag is removed from the receiving portion of the detaching unit.

In some scenarios, an optional step 1744 may be performed. For example, if step 1704 simply involves accepting an article for a purchase transaction, then option step 1744 may be performed to complete the purchase transaction. Subsequent to completing step 1742 or 1744, step 1746 is performed where method 1700 ends or other processing is performed.

Figure 18:
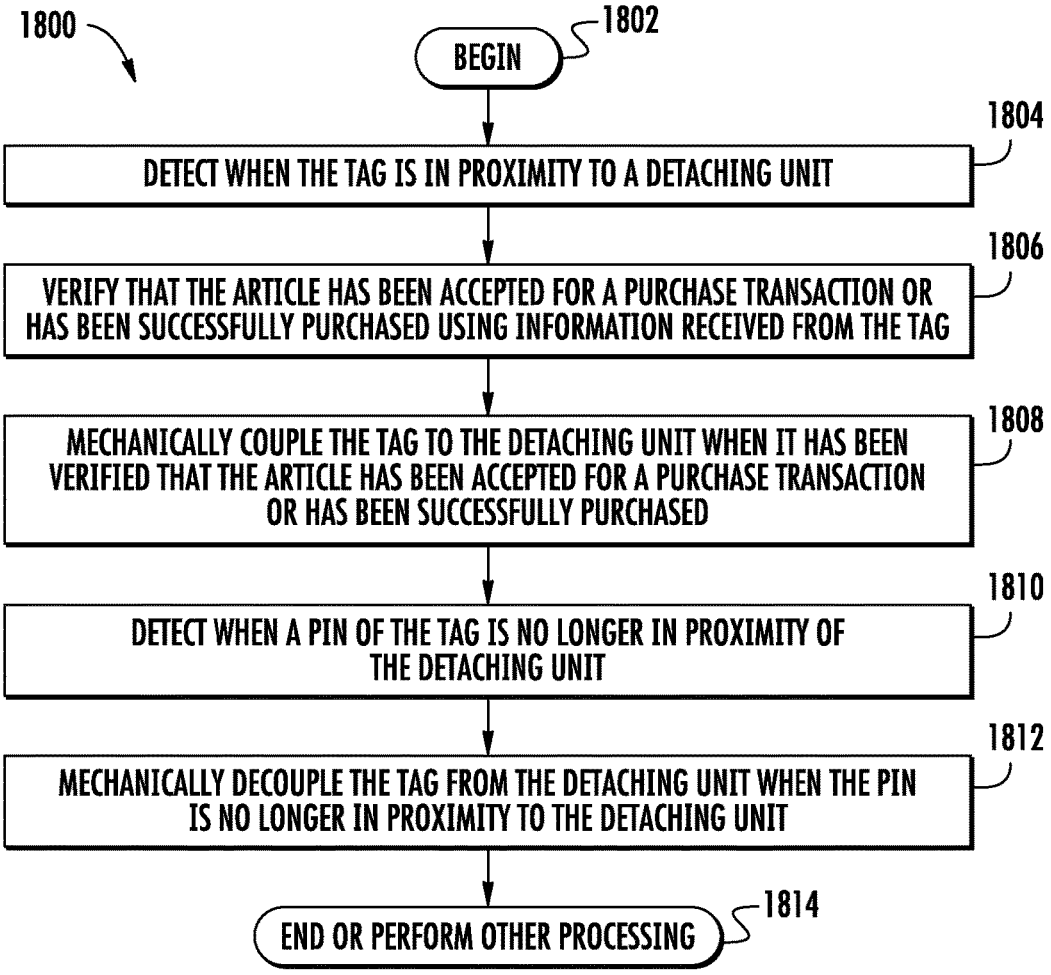
FIG. 18 is a flow diagram of an exemplary method for detaching a tag from an article.

The above method 1700 can be generalized as shown in FIG. 18. FIG. 18 comprises a flow diagram of an exemplary method 1800 for detaching a tag from an article. Method 1800 begins with step 1802 and continues with step 1804 where the detaching unit detects when the tag is in proximity thereto. Next, operations are performed in step 1806 to verify that the article (to which the tag is coupled) has been accepted for a purchase transaction or has been successfully purchased using information received from the tag. When such verification has been made, the tag is mechanically coupled to the detaching unit, as shown by step 1808. Thereafter, the detaching unit detects when a pin (or tack) of the tag is no longer in proximity of the detaching unit, as shown by step 1810. When the pin (or tack) is no longer in proximity to the detaching unit, the tag is mechanically decoupled from the detaching unit in step 1812. Subsequently, step 1814 is performed where method 1800 ends or other processing is performed.

Notably, the present solution has been described in relation to a magnetic detaching unit. The present solution is not limited in this regard. For example, the present solution can also be used with a power detaching unit. An exemplary power detaching unit is described in U.S. Pat. No. 5,535,606.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

I claim:

1. A method for operating a detaching unit to detach a tag from an article, comprising:

using a wireless receiver of the detaching unit to detect when the tag is in proximity to a detaching unit;

receiving, by the detaching unit, information from an external device to obtain verification that the article has been accepted for a purchase transaction or has been successfully purchased using information received from the tag;

operating the detaching unit to prevent a tag body from being removed from the detaching unit when it has been verified that the article has been accepted for a purchase transaction or has been successfully purchased;

detecting when a pin of the tag is no longer in proximity of the detaching unit; and deactivating the detaching unit and operating the detaching unit to allow the tag body to be removed from the detaching unit in response to said detecting.

2. The method according to claim 1, wherein the detaching unit comprises a magnetic or power detacher.

3. The method according to claim 1, wherein the tag is an Electronic Article Surveillance ("EAS") tag.

4. The method according to claim 1, wherein said verification in made using an article identifier or a unique tag identifier obtained from the tag via a Radio Frequency ("RF") communication.

5. The method according to claim 1, wherein a detection is made that the pin is not in proximity to the detaching unit when a signal is no longer being generated by a non-linear electrical circuit disposed within or coupled directly to the pin.

6. The method according to claim 5, wherein the non-linear electrical circuit comprises a frequency mixer.

7. The method according to claim 1, wherein a detection is made that the pin is no longer in proximity to the detaching unit when a signal generated by an electrical circuit disposed within or coupled directly to the pin stops being received by the detaching unit.

8. The method according to claim 1, further comprising:

supplying power to a field source of the detaching unit subsequent to when the tag body is prevented from being removed from the detaching unit; and discontinuing the supply of power to the field source when a detection is made that the pin is no longer in proximity to the detaching unit and prior to when the tag body is allowed to be removed from the detaching unit.

9. The method according to claim 1, further comprising concurrently performing the following operations (1) and (2) by the detaching unit:

(1) producing at least one signal when the tag is in proximity to the detaching unit whereby an electrical circuit disposed within or coupled directly to the pin is caused to generate a response signal; and (2) applying a magnetic field to the tag whereby the pin is released from a locking mechanism disposed within the tag body.

10. A system, comprising:

a tag comprising a tag body and a pin; and a detaching unit configured to detect when the tag is in proximity thereto, prevent a tag body from being removed therefrom when it has been verified that an article to which the tag is attached has been accepted for a purchase transaction or has been successfully purchased, detect when the pin of the tag is no longer in proximity of the detaching unit, and deactivate at least one of the detaching unit's functions and allow the tag body to be removed therefrom in response to the detection that the pin is no longer in proximity to the detaching unit.

11. The system according to claim 10, wherein the detaching unit comprises a magnetic or power detacher.

12. The system according to claim 10, wherein the tag is an Electronic Article Surveillance ("EAS") tag.

13. The system according to claim 10, wherein a verification is made that the article has been accepted for a purchase transaction or has been successfully purchased using an article identifier or a unique tag identifier obtained from the tag via a Radio Frequency ("RF") communication.

14. The system according to claim 10, wherein a detection is made that the pin is not in proximity to the detaching unit when a signal is no longer being generated by a non-linear electrical circuit disposed within or coupled directly to the pin.

15. The system according to claim 14, wherein the non-linear electrical circuit comprises a frequency mixer.

16. The system according to claim 10, wherein a detection is made that the pin is no longer in proximity to the detaching unit when a signal generated by an electrical circuit disposed within or coupled directly to the pin stops being received by the detaching unit.

17. The system according to claim 10, wherein the detaching unit is further configured to:

supply power to a field source of the detaching unit subsequent to when the tag body is prevented from being removed from the detaching unit; and discontinue the supply of power to the field source when a detection is made that the pin is no longer in proximity to the detaching unit and prior to when the tag body is allowed to be removed from the detaching unit.

18. The system according to claim 10, wherein the detaching unit is further configured to concurrently perform the following operations (1) and (2):

(1) produce at least one signal when the tag is in proximity to the detaching unit whereby an electrical circuit disposed within or coupled directly to the pin is caused to generate a response signal; and (2) apply a magnetic field to the tag whereby the pin is released from a locking mechanism disposed within the tag body.

* * * * *